US006821389B2

(12) United States Patent
Halmschlager et al.

(10) Patent No.: US 6,821,389 B2
(45) Date of Patent: Nov. 23, 2004

(54) PROCESS FOR MONITORING A DRAINAGE ELEMENT

(75) Inventors: Günter Halmschlager, Krems (AT); Herbert Haunlieb, Loosdorf (AT); Christoph Haase, Neulengbach (AT); Stefan Lehner-Dittenberger, Wilhelmsburg (AT); Rüdiger Keinberger, Aigen (AT); Helmut Fitzke, Herzogenburg (AT); Herbert Boden, St. Pölten (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/761,103

(22) Filed: Jan. 20, 2004

(65) Prior Publication Data

US 2004/0163786 A1 Aug. 26, 2004

Related U.S. Application Data

(62) Division of application No. 10/145,855, filed on May 14, 2002, now Pat. No. 6,752,909.

(30) Foreign Application Priority Data

May 15, 2001 (DE) ..... 101 23 529
Dec. 21, 2001 (DE) ..... 101 63 575

(51) Int. Cl.[7] ..... D21F 7/00
(52) U.S. Cl. ..... 162/198; 700/128
(58) Field of Search ..... 162/198, 263, 162/351–352, 363, 364, 374, 366; 700/127–129

(56) References Cited

U.S. PATENT DOCUMENTS 4,191,612 A * 3/1980 Araoka ..... 162/352
4,306,934 A * 12/1981 Seppanen ..... 162/209
4,718,983 A * 1/1988 Ibrahim ..... 162/252
5,089,090 A * 2/1992 Hansen ..... 162/351
5,858,175 A * 1/1999 Feiler ..... 162/374
6,375,799 B1 * 4/2002 Halmschlager et al. ..... 162/186
6,444,094 B1 * 9/2002 Rulis et al. ..... 162/352
2002/0170692 A1 * 11/2002 Halmschlager et al. ..... 162/158
2003/0024673 A1 * 2/2003 Van Essen et al. ..... 162/212

FOREIGN PATENT DOCUMENTS

DE PS 233 618 8/1909 ..... 55/16
DE 3305539 C1 * 8/1984 ..... D21F/1/52
DE 29615823 U1 * 10/1996 ..... D21F/1/48
DE 10123529 A1 * 11/2002 ..... D21F/7/00
DE 10163575 A1 * 7/2003 ..... D21F/1/48
EP 0 831 173 A2 9/1997 ..... D21F/1/48

* cited by examiner

*Primary Examiner*—José A. Fortuna
(74) *Attorney, Agent, or Firm*—Taylor & Aust, P.C.

(57) ABSTRACT

The present invention is a machine for manufacturing a fibrous web from a fibrous suspension, with a sheet forming area that exhibits at least one suction box, which includes a main box with at least one suction box cover that is formed from at least two drainage elements that run laterally to the machine's running direction, border a suction slit, and each has one main body and at least one ceramic. The present invention is identified by the fact that at least; one drainage element and/or one format slide exhibit at least one removable edge piece in which is integrated at least one temperature sensor in order to measure the temperature in the ceramic and/or the temperature at an adhesive point between the ceramic and the associated main body and/or the temperature in the main body. The present invention is furthermore a process and a system for monitoring a drainage element.

24 Claims, 4 Drawing Sheets

PROCESS FOR MONITORING A DRAINAGE ELEMENT

This application is a division of application Ser. No. 10/145,855 filed on May 14, 2002, now U.S. Pat. No. 6,752,909.

BACKGROUND OF THE INVENTION

1. Field of the Invention

The present invention relates to a process and a system for monitoring a paper machine's drainage element, which includes at least one ceramic.

2. Description of the Related Art

A suction box used in a system for monitoring a paper machine's drainage element is known, for example, from German patent specification DE-PS 233 618 and European patent registration EP 0 831 173 A2 (PB10359 EP).

Not enough rinse water during the start up phase of the machine for manufacturing a fibrous web (especially a paper, cardboard or tissue web) from a fibrous suspension can lead to overheating of the drainage elements. The resulting thermal load can be particularly damaging when thermal tensions arise in the ceramic, which could lead to a fracture in the ceramic, or when glued points between the ceramic and the main body soften, thereby creating the danger that the ceramic may slide or detach.

In general, there are two different possibilities that could lead to failure of a ceramic:

1. The adhesive remains stable and the ceramic breaks due to the direct thermal load on the ceramic.

2. The ceramic itself would withstand the thermal load, but the adhesive becomes soft and the small individual ceramic plate protrudes in one area progressively into the wire. This leads to a greater thermal load, resulting in fracture.

Of course, a combination of both cases may also occur. For case 1, the temperature is measured close to the surface of the ceramic: for case 2, the temperature is measured on the adhesive point. Due to the constantly increasing machine speeds, even a short period of insufficient cooling, which can never be ruled out under practical operational conditions, could lead to destruction of the ceramic.

Although the article "Auswahlkriterien für Keramik-Bel äge in schneillaufenden Papiermaschinen unter Ber ücksichtigung ihres Einflusses auf die Konstanz der Siebpartie", written by K. D. Fuchs and published in, among other publications. Wochenblatt, für Papierfabrikation 23/24, 2000, (pages 1631–1635, especially page 1633, left column) mentions simulation experiments with which thermal elements are used to measure the temperature on the lining surfaces in the wet section (sheet formation unit) and in the press section, the article deals primarily with the criteria for selecting ceramic coatings. Moreover, apparently temperature was measured only on the surface of the ceramic.

SUMMARY OF THE INVENTION

A machine for manufacturing a fibrous web, and, more particularly, a paper, cardboard, or tissue web, from a fibrous suspension, with a sheet forming area in which the developing fibrous web is led by way of at least one porous fabric, especially a mesh screen, over at least one suction box that has a main box that has at least one connection, including a line, to at least one vacuum source. The at least one suction box also has at least one suction box covering that is formed by at least two drainage elements, especially drainage rails, that run laterally to the machine's running direction, border a suction slit, and each of which has one main body and at least one ceramic, whereby preferably each of the at least one suction slits in both edge zones of the fabric is bordered by a format slide that has a main body and at least one ceramic. The term sheet-forming unit includes both a former, for example, a twin-wire former or a hybrid former, as well as a wire section, especially a Fourdrinier wire part.

The present invention provides an improved machine for manufacturing a fibrous web from a fibrous suspension with which is ensured economical and reliable monitoring of the affected drainage elements and with which possible damage is avoided. An advantage of the invention is simple and economical subsequent installation and exchange of temperature sensors on existing drainage elements.

According to the present invention, a machine for manufacturing a fibrous web from a fibrous suspension accomplishes this task with at least one drainage element and/or format slide that exhibits a removable edge piece inside which at least one temperature sensor is integrated.

These temperature sensors can be used to measure the temperature in the ceramic and/or the temperature at an adhesive point between the ceramic and the related main body and/or the temperature in the main body, thereby ensuring economical and reliable monitoring of the affected drainage elements and avoidance of potential damages.

The removable edge piece also creates the ideal condition both for simple and economical subsequent installation of a temperature measurement system as well as rapid and economical exchange of temperature sensors on existing drainage elements.

There are two primary preferred temperature measurement positions. In the first form, the temperature sensor is placed in the ceramic close to the ceramic surface, where the maximum temperature appears, and on any desired position above the section of the width of the drainage element that is wetted by the fabric. The maximum temperature usually appears on edges, where the fabric contacts it or runs off. For this reason, temperature measurement without mechanical contact with the so-called "hot" spot (using infrared for example) is not practical. For this reason, a second promising form involves arranging the temperature sensor in a recess in the ceramic. The recess in the ceramic is normally created before sintering (when the ceramic is still green). The advantage of this method of production is that it does not contribute to internal stresses in the ceramic or in the area around the recess or opening. The recess can be created especially during a molding process.

A temperature measurement is generally practical in the machine's direction of operation only at the following locations:

a) at the beginning and end of a drainage element for example, at the first and last drainage rails of a suction box.

b) especially where there is a high vacuum and/or a fabric guide with a rail or a lining.

c) in general anywhere there is a high specific pressure of the fabric on the ceramic and/or d) where there is insufficient lubrication caused by low drainage or the absence of spray water.

Accordingly, a temperature sensor is planned for at least one of the mentioned locations as needed.

It is also advantageous when several temperature sensors are arranged laterally to the machine's running direction at an appropriate distance from each other. The distance between the measurement points can be approximately 500 mm, for example, Thermocouples are the preferred temperature sensor type because they have historically demonstrated satisfactory price/performance, operational safety and maintenance characteristics.

The preferred material for the main body of the drainage element is glass fiber-reinforced plastic. This tape of material has proven its value in the paper industry.

From the perspective of costs and process technology, the ceramic of the drainage element and/or the format slide is shaped like a small ceramic plate and has a height of 1 mm to 10 mm, preferably, from 2 mm to 6 mm.

The format slide can be slid laterally relative to the machine's running direction in order to facilitate simple adjustment of the width of an individual suction zone and thereby the suction box's individual suction surface.

The format slide includes either one part or several parts, each preferably with a constant height. Both variations of the format slide can be equipped with at least one height adjustment mechanism, whereby the preferred design of the height adjustment mechanism consists of at least one adjustment screw together with the accompanying locking screw.

In another embodiment, height adjustment can be accomplished through mutual sliding of the format slide with the drainage element. In order to avoid or reduce by the greatest degree possible damage and/or wear to the fabric running over the drainage element, the format slide has an extension that extends in the direction of the middle of the machine and preferably comes into contact with the fabric. In addition, the extension should be permeable for a fluid such as air or water.

When viewed from above, the extension is wedge-shaped and/or perforated to increase permeability for the fluid. The format slide can also exhibit a surface profile in contact with the fabric that is very similar to that of the drainage element.

According to a second aspect, the present invention is based on the task of providing an improved process and an improved system, as described previously, with which is ensured economical and reliable monitoring of the affected drainage elements and with which possible damages are avoided.

According to the present invention, this second task is accomplished with a process for monitoring a paper machine's drainage element, which includes at least one ceramic, with the following process stops:

a) the temperature is measured in the ceramic, and/or on one adhesive point between the ceramic and a related main body, and/or in the main body.

b) the obtained temperature measurement value is analyzed in a process control system related to the paper machine and is preferably compared with at least one selectable threshold value.

c) depending on the result of the analysis or when the selectable threshold value is exceeded, the process control system automatically activates or influences as appropriate at least one control element in order to indicate that the threshold value has been exceeded and/or to initiate at least one appropriate countermeasure that will counteract further heating of the monitored area and/or cool the monitored area.

This design not only ensures automatic monitoring of the affected drainage element but also ensures that countermeasures will be automatically initiated by a process control system upon reaching a critical temperature, for example, in order to prevent further generation of heat and therefore possible damage. In other words, process steps will be automatically initiated as necessary in order to affect for example, slow cooling of the ceramic material.

In addition, the design takes into account the fact that, with respect to thermal loads, there are in principle two critical locations on the ceramic, namely the adhesive point and the area of the ceramic close to the surface.

Considering the adhesive, the adhesive's softening point is lower than the temperatures that could lead to failure of the ceramic due to thermal stresses. Therefore, it is advantageous to monitor the temperature at the adhesive point. If the adhesive softens, the positions of the individual ceramic plates may become unstable. As a result, the pieces may fall further into the wire and thereby be subjected to higher thermal stresses, which could lead to failure. Furthermore, a chance to the plate's location could cause increased wear to the wire and have negative effects on the formation of the paper or cardboard. The process according to the present invention can counteract this.

According to a preferred design of the process according to the present invention, temperature measurement is part of a control system that also includes signal conversion, which follows the measurement of temperature, as well as data processing performed by way of the process control system.

Regarding the ceramic surface, the temperature in the ceramic should be measured close to the surface of the ceramic, where the maximum temperature occurs.

The maximum temperature usually appears at edges where the wire contacts it or runs off. For this reason, temperature measurement without mechanical contact with the so-called "hot" spot (using infrared for example) is not practical. According to practical design of the process according to the present invention, a recess is created in the ceramic, a temperature sensor is placed into the recess, and the temperature in the ceramic is measured by the temperature sensor in the recess. The recess in the ceramic is normally created before sintering (when the ceramic is still green). The advantage of this method of production according to the present invention is that it does not contribute to internal stresses in the ceramic or in the area around the recess or opening. The recess can be created especially during a molding process. Although the recess should be created when the ceramic is in the green state (before sintering), it is also possible to work the recess into the ceramic after the ceramic has been sintered.

It is advantageous for at least one of the following countermeasures to be initiated if a respective threshold value is exceeded:

a) reduction of the speed of the mesh screen, preferably to standstill;

b) particularly slow increase of the rinse water volume;

c) reduction of the vacuum on the drainage element.

To do so, at least one of the followings steps, for example, can be initiated. At least one spray tube, for example, can be appropriately influenced in order to change the spray water flow rate. To change the speed of the paper machine, at least one of the paper machine's drives can be appropriately influenced. To reduce the vacuum on the drainage element, at least one valve can be appropriately adjusted. In addition, it is also possible, for example, to reduce the wire tension by appropriately adjusting at least one tension roller. If a threshold value is exceeded, an alarm signal, for example, can also be generated. It is advantageous if the alarm signals when the measured temperature exceeds approximately between 80° C. and 120° C. or when the rate of temperature increase is greater than 2° C. per second. The previously mentioned control elements can be, for example, spray tubes, paper machine drives, valves, tension rollers, signal emitters, and/or similar devices.

According to a functional design of the process according to the present invention, first a warning signal is generated when an initial threshold value is exceeded and, when another threshold value is exceeded, at least one corresponding countermeasure is initiated with which further warning of the monitored area is counteracted and/or the monitored area is cooled.

A temperature measurement is generally practical in the machine's direction of operation only at the following locations:

a) at the beginning and end of a drainage element, for example, at the first and last ceramic rail of a flat suction box;

b) especially where there is a high vacuum and/or a wire guide with a rail or lining;

c) in general, wherever the wire exhibits a specific high pressure on the ceramic and/or d) where there is insufficient lubrication caused by low drainage or the absence of spray water.

Accordingly, a thermal sensor is planned for at least one of the mentioned locations, as needed.

It is also advantageous if the temperature is measured, viewed laterally to the machine's running direction, at several points separated from each other by an appropriate distance. Accordingly, the distance between the measurement points can be approximately 500 mm, for example.

A thermocouple is the preferred temperature sensor.

The monitoring system according to the invention includes as appropriate at least one temperature sensor, connected to a process control system assigned to the paper machine, in order to measure the temperature in the ceramic and/or the temperature at an adhesive point between the ceramic and an assigned main body and/or the temperature in the main body, whereby the obtained temperature measurement value is analyzed in the process control system and preferably compared with at least one selectable threshold value. Depending on the result of the analysis or when the selectable threshold value is exceeded, the process control system can automatically appropriately activate or influence a control element in order to signal that the threshold value has been exceeded and/or initiate at least one appropriate countermeasure with which further warming of the monitored area is counteracted and/or the monitored area will be cooled.

It is clear that the invention's previously described characteristics and the characteristics to be described in the following can be used not only in the indicated combination, but also in other combinations or individually without leaving the framework of the present invention.

BRIEF DESCRIPTION OF THE DRAWINGS

The above-mentioned and other features and advantages of this invention, and the manner or attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
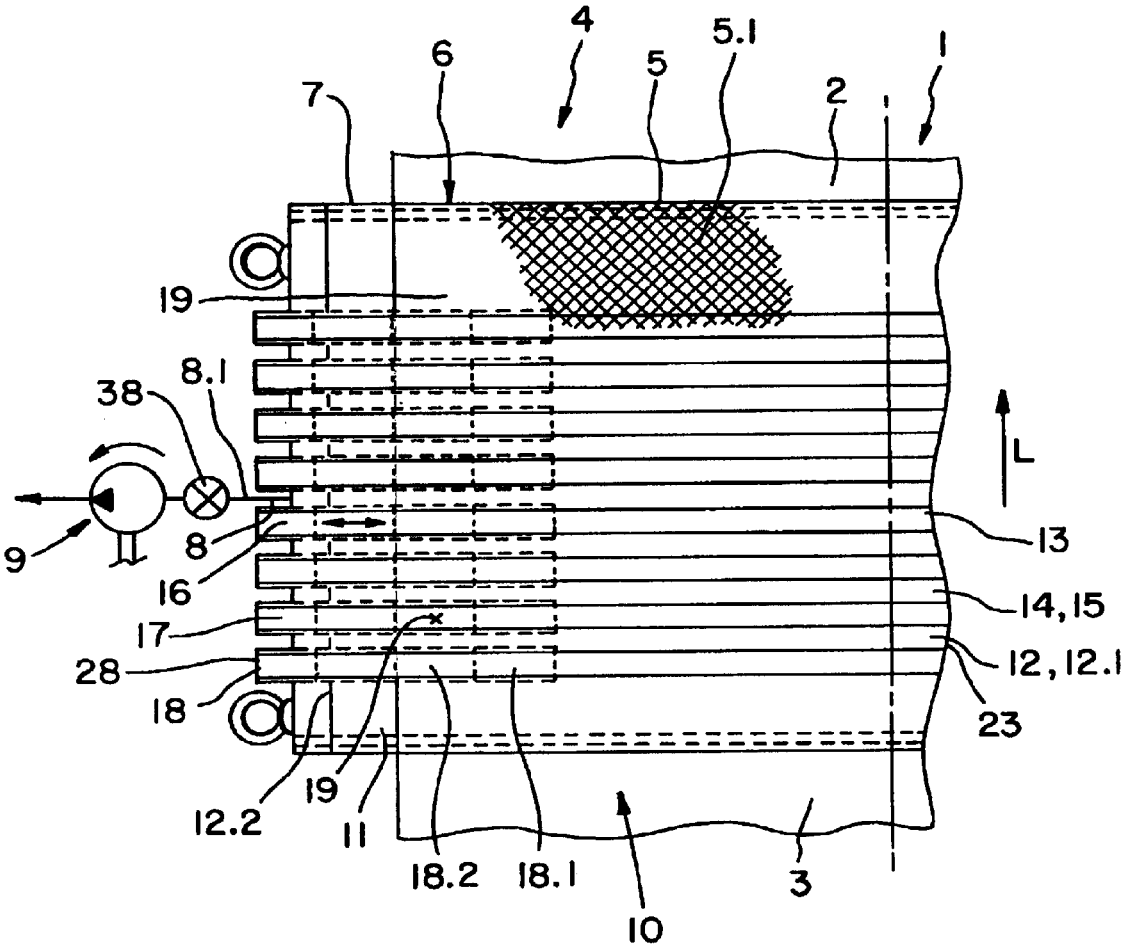
FIG. 1 is a schematic top view of an embodiment of the machine's suction box according to the present invention.

Referring now to the drawings, and more particularly to FIG. 1, there is shown a schematic top view of a suction box 6 of a machine 1 for manufacturing a fibrous web 2, especially a paper, cardboard, or tissue web, from a fibrous suspension 3 which generally includes a sheet formation area 4, whereby suction box 6 is shown only in a cut-away view. In sheet formation area 4, the developing fibrous web 2 is led by way of at least one porous fabric 5, especially a mesh screen 5.1, over at least one suction box 6 that includes a main box 7 that has at least one connection 8, including a line 8.1, to at least one vacuum source 9. The at least one suction box 6 also includes at least one suction box covering 11 that is formed by at least two drainage elements 12, especially drainage rails 12.1, that run laterally to the machine's running direction L (arrow), border a suction slit 13, and each of which has one drainage element main body 14 and at least one drainage element ceramic 15. Each of the at least one suction slits 13 is preferably bordered in both edge zones 10 of the fabric by a format slide 16 that includes a format slide main body 17 and at least one format slide ceramic 18. According to the present inventions at least one drainage element 12 and/or one format slide 16 exhibits at least one removable edge piece 12.2, 18.1, 18.2 in which at least one temperature sensor 19 is integrated in order to measure the temperature in drainage element ceramic 15 and/or at drainage element adhesive point 23 between drainage element ceramic 15 and drainage element main body 14 and/or the temperature in drainage element main body 14 and/or the temperature in format slide ceramic 18 and/or the temperature at format slide adhesive point 28 between format slide ceramic 18 and format slide main body 17 and/or the temperature in format slide main body 17. Edge piece 12.2, 18.1, 18.2 can be fastened to format slide main body 17 through the use of adhesive and/or clamps, several types of which have already been revealed. Regardless of the type of fastener, one hundred percent functional security must be ensured under all conditions.

Viewed from the machine's running direction L (arrow), at least one temperature sensor 19 is placed at the beginning and/or the end of drainage element 12.

Furthermore, it is advantageous for format slide 16 to be movable lateral to the machine's running direction L. The movement can be accomplished manually by using a positive or non-positive locking fastener, or electromechanically. However, several other movement and locking mechanisms that are well known among one of ordinary still in the art may be possible.

A thermocouple, well known as such, is intended as temperature sensor 19.

Figure 2A:
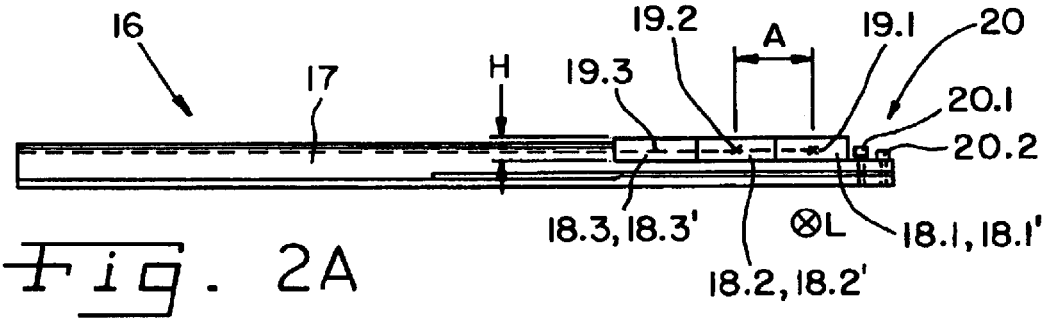
FIG. 2A is a schematic side view of an embodiment of the machine's format slide according to the present invention.
Figure 2B:
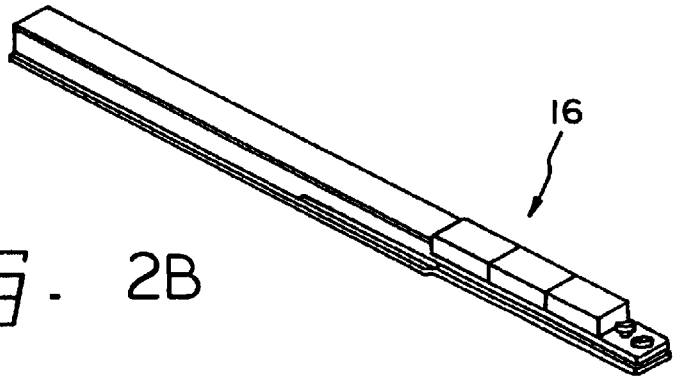
FIG. 2B is a perspective view of an embodiment of the machine's format slide of FIG. 2A according to the present invention.
Figure 3A:
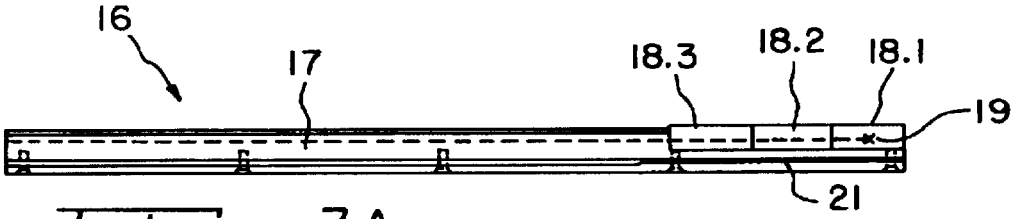
FIG. 3A is a schematic side view of the machine's format slide according to another embodiment of the present invention.
Figure 3B:
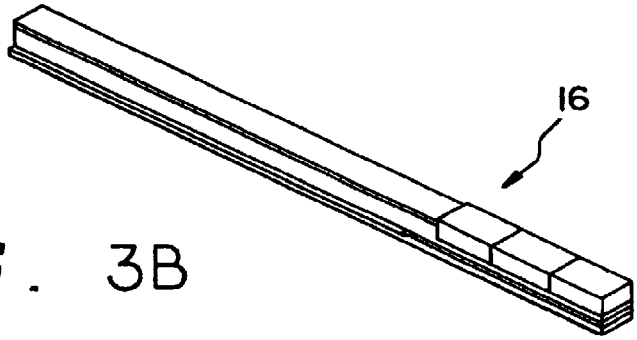
FIG. 3B is a perspective view of the machine's format slide according to another embodiment of the present invention.

FIGS. 2A and 3A show two schematic side views of format slide 16 of different embodiments of the present invention, whereas FIGS. 2B and 3B show two perspective images of format slides 16 of FIGS. 2A and 3A respectively.

According to the present invention, format slide 16 in FIG. 2A includes format slide main body 17 and three removable edge pieces 18.1, 18.2, 18.3, whereby temperature sensors 19.1, 19.2 are integrated into each of edge pieces 18.1, 18.2, respectively. According to the present invention, it is further intended that several temperature sensors 19.1, 19.2 are planned and arranged at a respective distance A from each other as viewed laterally to the machine's running direction L, whereby the distance A between the measurement points is about 500 mm. The at least one connection line 19.3 for temperature sensors 19.1, 19.2 is shown with a dashed line.

Furthermore, format slide main body 17 of format slide 16, which of course can also be a drainage element (and/or the drainage element) may be constructed from glass fiber reinforced plastic.

Edge pieces 18.1, 18.2, 18.3 of format slide 16 (and/or the drainage element) are in the shape of small ceramic plates 18.1', 18.2', 18.3' and exhibit a height H ranging from 1 mm to 10 mm, preferably from 2 mm to 6 mm.

Format slide 16 of FIG. 2A is a one-piece object with a preferably constant height and is equipped with at least one height adjustment mechanism 20. Height adjustment mechanism 20 in the preferred embodiment has at least one adjustment screw 20.1 with the accompanying locking screw 20.2.

FIG. 2B shows a perspective view of format slide 16 of FIG. 2A.

According to the present invention, format slide 16 in FIG. 3A also includes format slide main body 17 and three removable edge pieces 18.1, 18.2, 18.3, whereby a temperature sensor 19 is integrated into edge piece 18.1.

Format slide 16 of FIG. 3A is a multiple-piece object with a preferably constant height and is equipped with at least one height adjustment device in the form of at least one intermediate sheet 21.

FIG. 3B shows a perspective view of format slide 16 of FIG. 3A.

Figure 4:
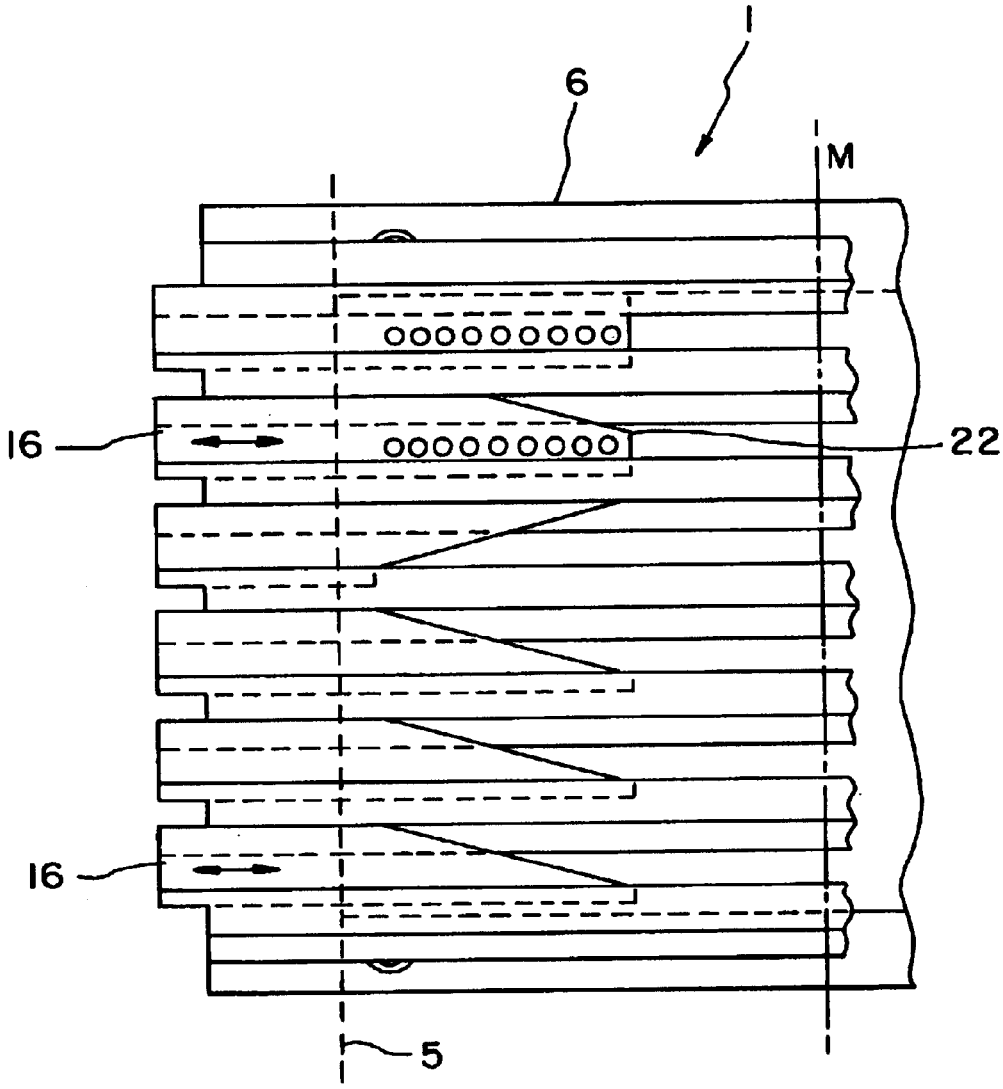
FIG. 4 is a second schematic top view of an embodiment of the machine's suction box according to the present invention.

FIG. 4 shows a second schematic top view of suction box 6 of machine 1 according to the present invention. Regarding the general description of suction box 6, reference is made to the description of suction box 6 of FIG. 1. According to the present invention the preferably movable format slide 16 exhibits an extension 22 that extends in the direction of machine middle M (dashed line) and preferably comes into contact with fabric 5. In addition, the extension is permeable for a fluid such as air or water. Extension 22 is preferably wedge-shaped and/or perforated when viewed from above. Format slide 16 also exhibits a surface profile in contact with fabric 5 that is very similar to that of drainage element 12.

Figure 5:
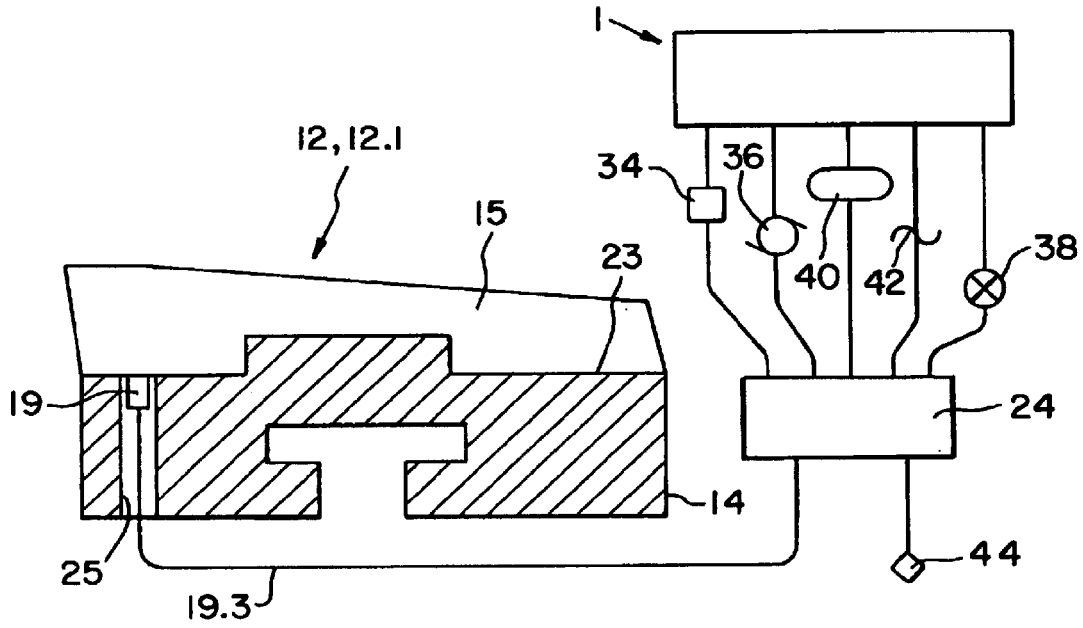
FIG. 5 is a schematic side view of an embodiment of the machine's drainage element according to the present invention.
Figure 6:
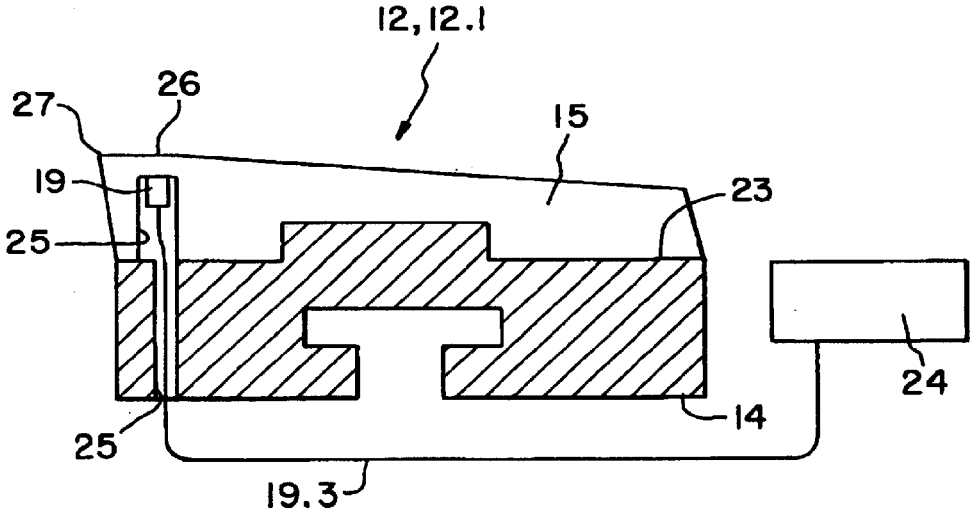
FIG. 6 is a schematic side view of the machine's drainage element according to another embodiment of the present invention.

Drainage rails 12.1 depicted in FIGS. 5 and 6 from a side view, each of which is assigned to a drainage element 12, each include drainage element main body 14 and drainage element ceramic 15 that is fastened to this with a drainage element adhesive point 23. One thermal element is assigned to each of drainage rails 12.1 as a temperature sensor 19. Each thermal element can be connected via connection line 19.3 to a process system 24, especially one that is assigned to machine 1.

The temperature measurement at drainage rail 12.1 depicted in FIG. 5 occurs on drainage element adhesive point 23. The temperature sensor 19 is placed in recess 25 provided in drainage element main body 14, bordering drainage element adhesive point 23.

The temperature measurement of drainage rail 12.1 depicted in FIG. 6 occurs at the so-called "hot" ceramic zone, which is within format slide ceramic 18, close to ceramic surface 26 where the maximum temperature appears. As seen in FIG. 6, temperature sensor 19 is placed in the area of an edge 27. Temperature sensor 19 is placed in a recess 25 in format slide ceramic 18, which adjoins recess 25 in main body 14 through which the connection line 19.3 is led outward. Recess 25 in drainage element ceramic 15 is created preferably during the ceramic's green state (before sintering). In addition, temperature sensor 19 can be placed on any desired position above the section of the drainage element width that is wetted by the fabric. A temperature measurement can be made in the machine's direction of operation at the beginning and end of a drainage element, for example, at the first and last ceramic rail of a flat suction box.

In both cases depicted in FIGS. 5 and 6, the obtained temperature measurement value is analyzed in process control system 24 assigned to paper machine 1 and preferably compared to at least one selectable threshold value. Depending on the result of the analysis or when the selectable threshold value is exceeded, process control system 24 automatically activates or influences as appropriate at least one control element in order to indicate that the threshold value has been exceeded and/or to initiate at least one appropriate countermeasure that will counteract further heating of the monitored area or cool the monitored area. This allows temperature measurement to be part of a control system that includes signal conversion (following temperature measurement) and data processing by means of process control system 24.

To do so, at least one of the following steps, for example, can be initiated. At least one spray tube 34, for example, can be appropriately influenced in order to chance the spray water flow rate. To change the speed of the paper machine, at least one of the paper machine's drives 36 can be appropriately influenced. To reduce the vacuum on the drainage element at least one valve 38 can be appropriately adjusted. In addition, it is also possible, for example, to reduce wire 42 tension by appropriately adjusting at least one tension roller 40. If a threshold value is exceeded, an alarm 44 signal, for example, can also be generated. It is advantageous if the alarm signals when the measured temperature exceeds approximately between 80° C. and 120° C. or when the rate of temperature increase is greater than 20° C. per second. The previously mentioned control elements can be, for example, spray tubes 34, paper machine drives 36. valves 38. tension rollers 40, alarms 44, and/or similar devices.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for monitoring a drainage element in a paper machine with a running direction, the drainage element including at least one drainage element ceramic, comprising the steps of:

measuring a temperature in at least one of the at least one drainage element ceramic, at least one drainage element adhesive point and a drainage element main body;

analyzing said temperature in a process control system;

comparing said temperature to at least one threshold value; and dependent upon said analyzing step, using said process control system for at least one of:

activating at least one control element to indicate said temperature has exceeded said threshold value; and initiating a countermeasure of one of discontinuing heating and commencing cooling in at least one of said at least one drainage element ceramic and at least one drainage element adhesive point and drainage element main body.

2. The method of claim 1, including the steps of performing signal conversion of said temperature and performing data processing of said temperature following said measuring step.

3. The method of claim 1, wherein said temperature is measured in said at least one drainage element ceramic on a surface of said at least one drainage element ceramic of maximum temperature.

4. The method of claim 1, including the steps of creating a recess in said at least one drainage element ceramic, inserting a temperature sensor into said recess and measuring said temperature in said at least one drainage element ceramic with said temperature sensor.

5. The method of claim 4, including the step of sintering said at least one drainage element ceramic after said creating step.

6. The method of claim 5, including the step of molding said at least one drainage element ceramic, said creating step occurring during said molding step.

7. The method of claim 5, wherein said creating step is performed by working said drainage element ceramic after said sintering step.

8. The method of claim 5, including the steps of at least one of reducing the speed of a mesh screen, slowing a spray water flow rate, and reducing the vacuum on said drainage element.

9. The method of claim 8, wherein said slowing step reduces said speed to approximately 0.

10. The method of claim 8, including adjusting at least one spray tube thereby changing said spray water flow rate.

11. The method of claim 1, including changing a drive in said paper machine thereby changing a speed of said paper machine.

12. The method of claim 1, including adjusting at least one valve thereby reducing the vacuum on said drainage element.

13. The method of claim 1, including adjusting at least one tension roller thereby reducing a wire tension.

14. The method of claim 1, including signaling an alarm if said at least one threshold value is exceeded by said temperature.

15. The method of claim 14, wherein said at least one threshold value is between approximately 800 C and 1200 C.

16. The method of claim 1, including signaling an alarm when said temperature has a rate of increase greater than 20 C per second.

17. The method of claim 1, including signaling an alarm if an initial said at least one threshold value is exceeded by said temperature and activating said initiating step if another said at least one threshold value is exceeded by said temperature.

18. The method of claim 17, wherein said initial at least one threshold value is between approximately 800 C and 1200 C.

19. The method of claim 1, wherein said signaling occurs when said temperature has a rate of increase greater than 20 C per second.

20. The method of claim 1, including locating at least one temperature sensor in at least one of beginning and end of said at least one drainage element as viewed from said running direction.

21. The method of claim 1, including measuring said temperature at least two positions spaced at a periodic distance lateral to said running direction.

22. The method of claim 21, wherein said periodic distance is approximately 500 mm.

23. The method of claim 1, including using a thermocouple to measure said temperature.

24. The method of claim 1, wherein said drainage element is a ceramic rail.

* * * * *

UNITED STATES PATENT AND TRADEMARK OFFICE

CERTIFICATE OF CORRECTION

PATENT NO. : 6,821,389 B2
DATED : November 23, 2004
INVENTOR(S) : Halmschlager et al.

It is certified that error appears in the above-identified patent and that said Letters Patent is hereby corrected as shown below:

Column 2,
Line 65, after “locations”, please insert -- , --.

Column 3,
Line 8, please delete “tape”, and substitute therefore -- type --.

Column 7,
Line 6, please delete “still”, and substitute therefore -- skill --.

Column 8,
Line 47, please delete “chance”, and substitute therefore -- change --.

Signed and Sealed this

Twenty-fourth Day of May, 2005

JON W. DUDAS
*Director of the United States Patent and Trademark Office*